US006598873B2

(12) United States Patent
Takisawa et al.

(10) Patent No.: US 6,598,873 B2
(45) Date of Patent: Jul. 29, 2003

(54) PAPER FEEDER

(75) Inventors: Masahiro Takisawa, Tochigi (JP); Takahisa Araki, Utsunomiya (JP)

(73) Assignee: Panasonic Communications Co., Ltd., Fukuoka (JP)

( * ) Notice: Subject to any disclaimer, the term of this patent is extended or adjusted under 35 U.S.C. 154(b) by 0 days.

(21) Appl. No.: 09/920,962

(22) Filed: Aug. 3, 2001

(65) Prior Publication Data

US 2002/0033572 A1 Mar. 21, 2002

(30) Foreign Application Priority Data

Sep. 21, 2000 (JP) ..... 2000-286324

(51) Int. Cl.[7] ..... B65H 9/04
(52) U.S. Cl. ..... 271/246; 271/254
(58) Field of Search ..... 271/245, 246, 271/253, 254

(56) References Cited

U.S. PATENT DOCUMENTS 4,674,736 A * 6/1987 Tsubo ..... 271/122
4,844,443 A * 7/1989 Trafton ..... 271/245
5,655,762 A * 8/1997 Yergenson ..... 271/121
6,199,855 B1 * 3/2001 Choeng et al. ..... 271/122
6,307,621 B1 * 10/2001 Endo et al. ..... 355/407

FOREIGN PATENT DOCUMENTS

JP 7-38283 8/1995

* cited by examiner

*Primary Examiner*—Christopher P. Ellis
*Assistant Examiner*—Mark A. Deuble
(74) *Attorney, Agent, or Firm*—Greenblum & Bernstein, P.L.C.

(57) ABSTRACT

A pickup roller is movable in a vertical direction and pulls out papers to the paper feed rollers, is provided. The pickup roller moves down towards the papers stacked on the paper tray. A front edge alignment member that aligns the front edge of the papers and a stopper that controls rotation of the front edge alignment member engages the front edge alignment member. A stopper release member pivots the stopper to release it from the front edge alignment member in synchronization to the up and down movement of the pickup roller.

12 Claims, 9 Drawing Sheets

Prior Art

Prior Art

PAPER FEEDER

BACKGROUND OF THE INVENTION

1. Field of Invention

The present invention relates to a paper feeder that comprises a mechanism for aligning a front edge of papers that aligns front edges of supplied sheets of paper such as recording papers or documents, and is used for equipment such as a copier and a printer.

2. Description of Related Art

Conventionally, a mechanism for aligning paper front edges that align front edges of papers is installed in a paper feeder for equipment such as a copy machine and a printer in order to prevent plural papers from being fed or to prevent papers from being fed at a tilt or at an angle. This mechanism of aligning paper front edges prevents a problem of plural feeding or tilted feeding of papers when a bundle or stack of papers is pushed too strongly at the paper tray. In the conventional mechanism for aligning paper front edges, the paper front edge alignment member is moved in a vertical direction by a solenoid.

FIG. 13 is a side cross-sectional view that shows the internal structure of the conventional paper feeder. In order to stack papers on a paper supply tray 131, a paper front edge alignment member 133 is moved up by a solenoid 134 and front edge of the paper 132 is abutted against the paper front edge alignment member 133 to align the front edge of the papers 132.

On the other hand, in order to supply the stacked paper 132, the paper edge alignment member 133 is lowered by the solenoid 134 to remove the paper front edge alignment member 133 from the front edge of the paper 132. At the same time the pickup roller 135 moves down on to the surface of the stack of the paper 132 and advances a sheet to the paper feed roller 136 by rotation of the pickup roller 135.

However in such conventional paper feeder, the up and down moving mechanism for the paper front edge alignment member 133 is independent from the movement mechanism for the pickup roller 135. As a result, the structure becomes complicated and needs more space in the equipment. Hence it is an obstacle to the down sizing of the equipment. Further, although the timing of up and down movements of the paper front edge alignment member 133 and the timing of the up and down movements of the pickup roller 135 need to be synchronized. However the timing control is not easy because there two mechanisms are moved up and down by different mechanisms and this has been a cause of paper jams.

In order to solve the above problem, the paper feeder, which mechanically synchronizes the timing of the paper front edge alignment member moving down to the front edge of the papers and the timing of the up and down movement of the pickup roller, has been provided. For example, the timing for a paper front edge alignment member moving down on to the paper and the timing of up and down movement a pickup roller are mechanically synchronized as disclosed in Japanese utility model patent Laid-open No 2-57846.

FIG. 14 shows side cross-sectional views showing the internal structure of this paper feeder. The paper front edge alignment member 143 is mounted for rotation about the rotation shaft 147 of the pickup roller 146. And, the paper front edge alignment member 143 is interlocked with the up and down movement of the pickup roller 146. The paper front edge alignment member 143 has a first protrusion 144 and a second protrusion 145 that extend in different directions. The first protrusion 144 aligns the front edge of stacked paper 142 and the second protrusion 145 engages a separately provided stopper 148.

In this setup, when the paper front edge alignment member 143 moves up by the upward movement of the pickup roller 146, the pivot of the paper front edge alignment member 143 is restricted by the contact of the second protrusion 145 and the stopper 148. As the result, first protrusion 144 stops and aligns the front edge of the paper 142.

On the other hand, when the paper front edge alignment member 143 moves down by the down ward movement of the pickup roller 146, the contact of the second protrusion 145 and the stopper 148 is released, and the pivot control of the paper front edge alignment member 143 is released. As the result, the paper 142 moves by the rotation of the pickup roller 146 and pushes the first protrusion 144. Then the paper front edge alignment member 143 rotates and the first protrusion 144 moves away so that it does not block paper feeding.

In the paper feeder mentioned above, it is possible to achieve downsizing of space requirements because it is not necessary to have separate mechanism for moving the paper front edge alignment member 143. And it is also possible to reliably synchronize the timing of the up and down movement of the paper front edge alignment member 143 and of the pickup roller 146 confidently, because the paper front edge alignment member 143 is provided to pivot about the rotating shaft 147 of the pickup roller 146.

However, in a conventional paper feeder mentioned above, the following problem has occurred. When the pickup roller moves up, the paper front edge alignment member moves up together with it and the second protrusion touches the stopper. As the result, pivoting of the paper front edge alignment member is restricted even when the front edge of papers pushes the first protrusion.

In this situation, if the papers are pushed firmly against the first protrusion, the second protrusion on the other side of the first protrusion is pushed firmly to the stopper because pivoting of the paper front edge alignment member is restricted by the contact of the second protrusion and the stopper.

In this case, the stronger the pushing force of the second protrusion against the stopper, larger the friction between the second protrusion and the stopper becomes. If the pickup roller is moved down in this situation, the pickup roller does not move down smoothly because of the friction, and as a result it is possible that paper feed is prevented.

SUMMARY OF THE INVENTION

An object of the present invention is to provide a paper feeder that can reliably synchronize the up and down movements of the paper front edge alignment member and of the pickup roller. Another object of the present invention is to provide a paper feeder that can smoothly move the pickup roller even in the event that papers are firmly pushed against the paper front edge alignment member.

In the present invention, in order to solve the problem mentioned above, the paper feeder comprises a pickup roller that is provided to be movably in a vertical direction, and moves down towards the upper surface of stacked papers to advance a paper to a paper feed roller, a front edge alignment member that is pivotably mounted, and aligns the front edge of the stacked papers, a stopper that is pivotably mounted, and restricts the pivoting the front edge alignment member, and a stopper releasing section that releases the stopper from the front edge alignment section by rotating the stopper, in synchronization with the downward movement of the pickup roller.

BRIEF DESCRIPTION OF THE DRAWINGS

The present invention is further described in the detailed description which follow, with reference to the noted plurality of drawings by way of non-limiting examples of exemplary embodiments of the present invention, in which like reference numerals represent similar members throughout the several views of the drawings, and wherein.

DETAILED DESCRIPTION OF PREFERRED EMBODIMENTS

Hereafter a paper feeder of an embodiment of the present invention is described in detail using the various drawings.

Figure 1:
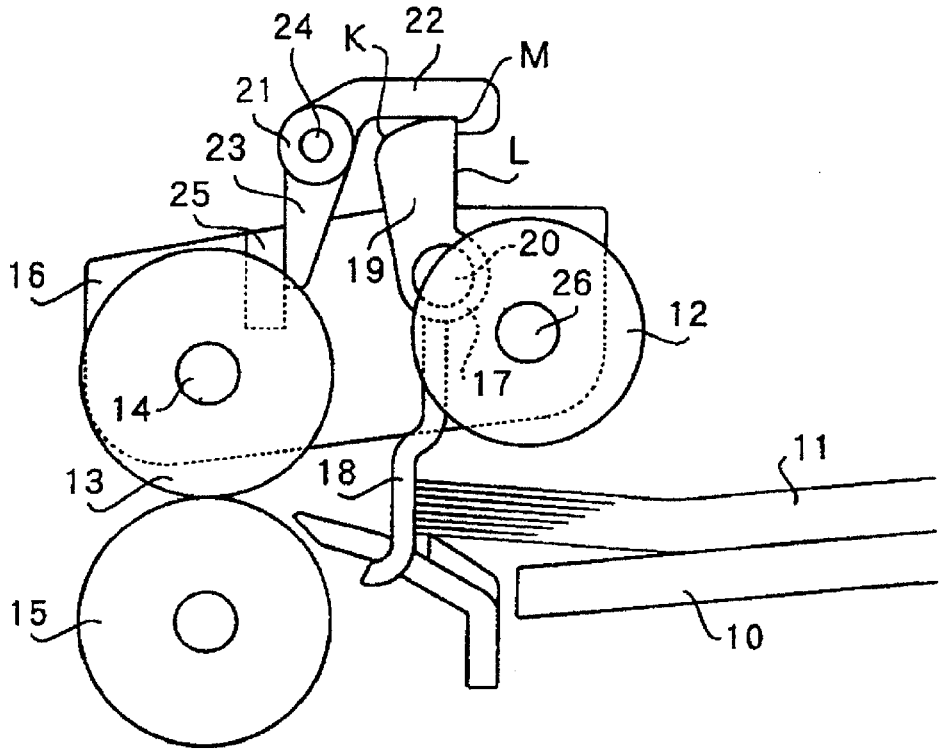
FIG. 1 is a side cross-sectional view showing the basic internal structure of the paper feeder of an embodiment of the present invention.

FIG. 1 is a side cross-sectional view showing the internal structure of the paper feeder of a embodiment of the present invention. As shown in FIG. 1, the pickup roller 12 is pivotedly mounted at the rotating arm 16 that pivots about the shaft 14 of the paper feed roller 13 of a paper feeder. The pickup roller 12 rotates by the power transmitted by a gear (that is not shown in the figure) when the paper feed roller 13 rotates.

The stopper release member 25 is made in one piece as a component of the pivot arm 16. The pickup roller 12 moves down in synchronization with the descent of the pivot arm 16, and moves down to the upper surface of the papers 11 stacked on the paper tray 10. The pickup roller 12 pulls out a paper to the paper feed roller 13 and 15. The pivot arm 16 moves down when the paper feed roller 13 rotates.

The front edge alignment member 17 is pivotedly mounted on the paper feeder and has a first arm 18 and a second arm 19 that extend to opposite directions each other from the pivot support 20. The first arm 18 of the front edge alignment member 17 aligns the front edge of the papers 11 stacked on the paper tray 10. This prevents the front edge of the papers 11 from being advances into the nip between the paper feed roller 13 and the paper feed roller 15 when papers 11 are pushed strongly when stacked on the paper tray 10.

When front edge of the paper 11 is advanced into the nip between the feed roller 13 and the feed roller 15, and starts a paper feed operation, double feeding and tilted feeding of papers often occurs. Such double feeding and tilted feeding of papers are prevented when the papers are transferred to the paper feed roller 13 and 15 by the pickup roller 12. The second arm 19 of the front edge alignment member 17 and the first arm 22 of the stopper 21 are interlocked.

The stopper 21 is mounted on the main body of the paper feeder and comprises a first arm 22 and a second arm 23 that extend in different directions from the pivot support point 24. The first arm 22 of the stopper 21 engages the second arm 19 of the front edge alignment member 17, and restricts the pivoting of the first arm 18 of the front edge alignment member 17.

The first arm 22 of the stopper 21 has a projection M, and presses the straight portion L of the second arm 19 of the front edge alignment member 17. The edge portion K of the second arm 19 of the front edge alignment member 17 contacts the first arm 22 of the stopper 21 when the front edge alignment member 17 moves upwardly. The edge portion K has an arcuate shape. Further the second arm 23 of the stopper 21 interlocks with the stopper release member 25.

Thus, pivoting of the edge is restricted because the first arm 22 of the stopper 21 firmly fixes the second arm 19 of the front edge alignment member 17. As the result, even when the papers 11 stacked on the paper tray 10 are pushed strongly towards the front edge alignment member 17, the pivoting of the edge can be restricted.

The stopper release member 25 is made together with the pickup roller 12 and the pivot arm 16 in one piece, and is movably in vertical direction around the shaft 14 of the paper feed roller 13 which is mounted in the paper feeder body. The stopper release member 25 rotates the second arm 23 of the stopper 21 in synchronization with the downward movement of the pickup roller 12, and releases the second arm 23 of the stopper 21 from the front edge alignment member 17.

Thus, it is possible to make the front edge alignment member 17 rotatable because the stopper release member 25 moves to rotate the stopper 21 to release the stopper 21 from the front edge alignment member 17 when the pickup roller 12 moves down.

A series of basic paper feed operation of the paper feeder of the present invention set up as mentioned above is described using the drawings from FIG. 2 to FIG. 11. FIG. 2 to FIG. 11 are status transition drawings from the pulling out of papers 11 from the paper tray 10 to the end of paper feed operation of transferring the paper to the paper feed roller 13 and 15. In other words these drawings show the positioning, orientation and operation of the various components at different stages in the operation of the paper sheet feed mechanism of the present invention.

Figure 2:
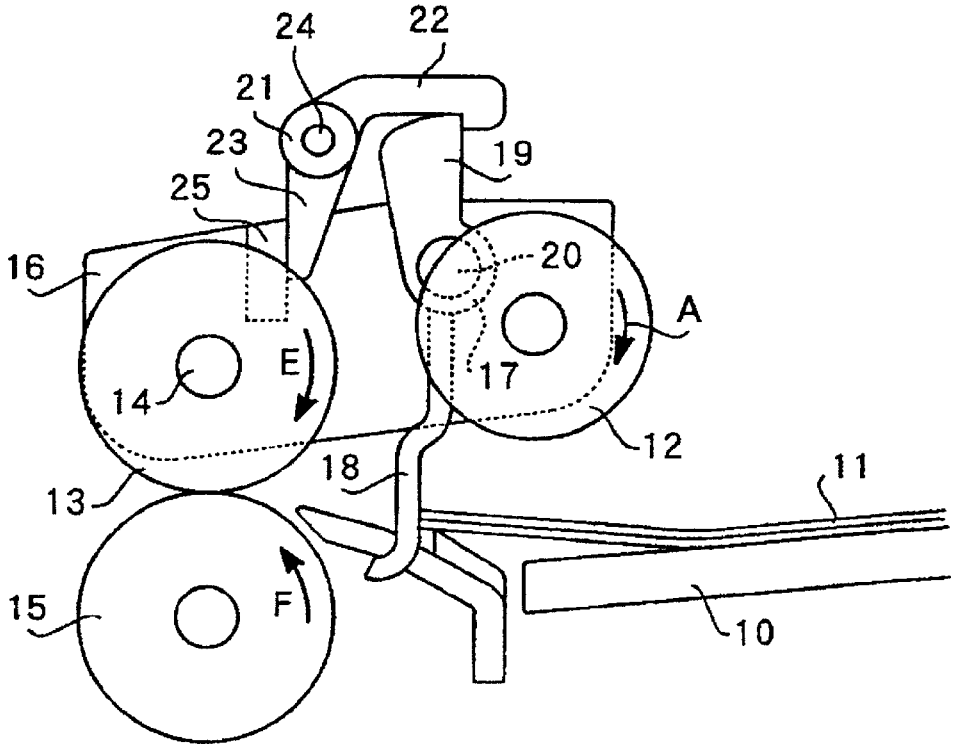
FIG. 2 is a drawing illustrating the device at a particular stage of basic paper feed operations in the paper feeder of the embodiment mentioned above.

FIG. 2 is a side cross-sectional view at the stage where the pickup roller 12, the paper feed roller 13 and 15 have started rotation in advance of paper feed operation. As shown in FIG. 2, the pickup roller 12 mounted on the pivot arm 16 starts rotation in the direction A, in synchronization with the rotation of the paper feed roller 13 and 15 in directions E and F.

However, at this situation, the second arm 23 of the stopper 21 is fixed abutting the stopper release member 25. Moreover, the front edge alignment member 17 is restricted from pivoting because the second arm 19 is engaged by the first arm 22 of the stopper 21. As a result, the papers 11 stacked on the paper tray 10 remain with the front edge being aligned.

Figure 3:
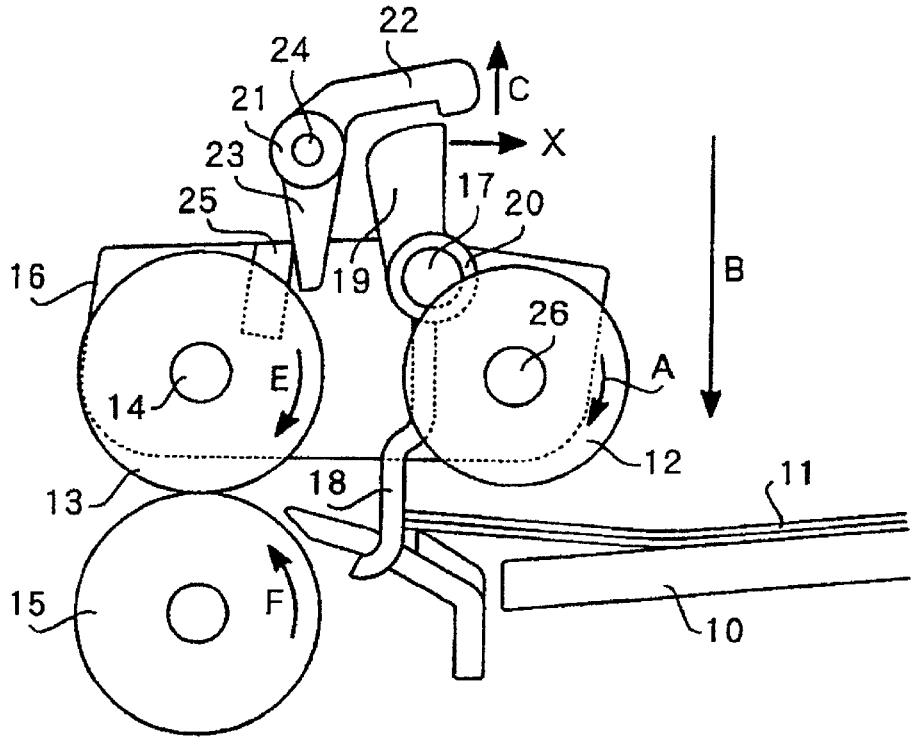
FIG. 3 is a drawing illustrating the device at a particular stage of basic paper feed operations in the paper feeder of the embodiment mentioned above.

FIG. 3 is a side cross-sectional view at the time that the pickup roller 12, paper feed rollers 13 and 15 rotate and the pivot arm 16 starts to move down. As shown in FIG. 3, the pickup roller 12, paper feed rollers 13 and 15 rotate in directions A, E and F, and the pivot arm 16 starts moving down to the direction B around the center of rotation 14 of the paper feed roller 13.

Coordinated with the downward movement of the pivot arm 16, the pickup roller 12 provided on the pivot arm 16 starts moving down to the direction B. At the same time, the stopper release member 25 moves to the direction to push the second arm 23 by pivoting about the pivot support 14 of the paper feed roller 13.

As mentioned above, by positioning the pivot support point 20 of the front edge alignment member 17 at a the different position than the shaft 26 of the pickup roller 12, the pivoting of the front edge alignment member 17 does not directly affect the downward movement of the pickup roller 12. Hence it is possible for the pickup roller 12 to move down smoothly even when the papers 11 are strongly pushed to the first arm 18 of the front edge alignment member 17.

Then the first arm 22 of the stopper 21 is pushed up about the pivot support point 24 in the direction C. And at the same time the second arm 19 of the front edge alignment member 17 is released to make the front edge alignment member 17 rotatable. However, the papers 11 stacked on the paper tray 10 are positioned with the front edge aligned.

Thus, even when the papers 11 are pushed strongly against the first arm 18 of the front edge alignment member 17, and the second arm 19 of the front edge alignment member 17 pushes the projection M of the first arm 22 of the stopper 21 in the horizontal direction, it is possible to make the front edge alignment member 17 easily rotatable, because the second arm 22 of the stopper 21 is pushed up strongly in the direction C by the stopper release member 25.

Here the stopper release member 25 is designed as an elongate shaped guide positioned close to the second arm 23 of the stopper 21 at a position such that the stopper 21 restricts the pivoting the front edge alignment member 17.

In this structure, the stopper release member 25 securely contacts and pushes the second arm 23 of the stopper 21 even when downward movement of the pickup roller 12 is small because of large amount of the papers 11. Hence the pivot prevention of the front edge alignment member 17 by the stopper 21 can be reliably released when the pickup roller 12 moves down regardless of the quantity of the papers stacked 11 and advancing of the papers 11 can be performed smoothly.

Figure 4:
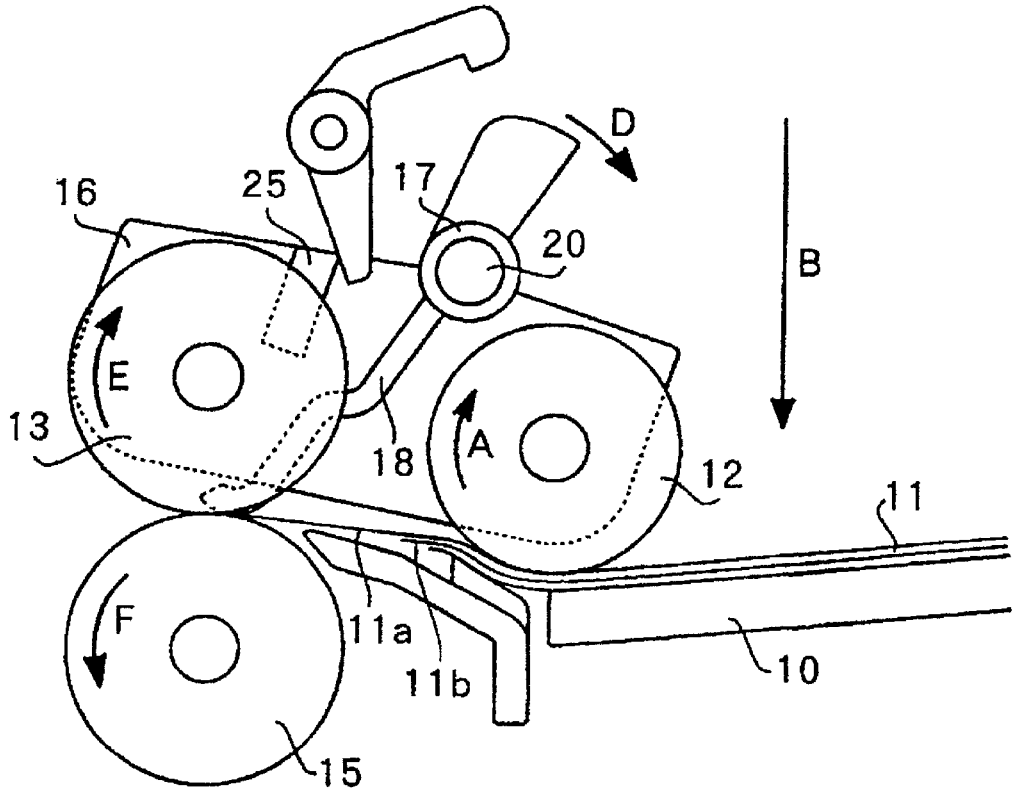
FIG. 4 is a drawing illustrating the device at a particular stage of basic paper feed operations in the paper feeder of the embodiment mentioned above.

FIG. 4 is a side cross-sectional view showing the position of the components when the pickup roller 12 pulls out the papers 11. As shown in FIG. 4, in synchronization with the downward movement of the pivot arm 16, the stopper release member 25 makes the front edge alignment member 17 rotatable. Then the pickup roller 12 that keeps rotating in the direction A keeps moving down in the direction B.

As the pickup roller 12 keeps moving down, it contacts the upper surface of the papers 11 stacked on the paper tray 10. Then the pickup roller 12 starts transferring (i.e. advancing) the first paper 11*a* on the top of papers 11 to the paper feed rollers 13 and 15 by the frictional action of the pickup roller 12 rotating in the direction A. Then the front edge of the paper 11*a* contacts the first arm 18 of the front edge alignment member 17.

The front edge alignment member 17 becomes rotatable before the pickup roller contacts to the upper surface of the papers 11 as mentioned above. Therefore, the front edge of the paper 11*a* is advanced by the friction of the rotating pickup roller 12 on the papers 11 in the direction A without being restricted by the first arm 18 of the front edge alignment member 17. Then, the front edge of the paper 11*a* pushes against the first arm 18 of the front edge alignment member 17 and rotates the front edge alignment member 17 around the pivot support point 20 in the direction D.

The first paper 11*a* pulled out from the paper tray 10 pushing the first arm 18 of the front edge alignment member 17 and, by friction of the rotating pickup roller 12 is continuously pulled in to the nip surface between the paper feed rollers 13 and 15. In this action, the second paper 11*b* that is stacked below the first sheet 11*a* is also pulled out from the paper tray 10.

As mentioned above, when the pickup roller 12 moves down, the stopper is released to make the front edge alignment member 17 rotatable. Then the papers 11 are pulled out one by one by the pivoting of the pickup roller 12. When the papers 11 push the front edge alignment member 17, the front edge alignment member 17 rotates and it is possible to allow the papers 11 pulled out one by one, to be fed to the paper feed rollers 13 and 15.

Figure 5:
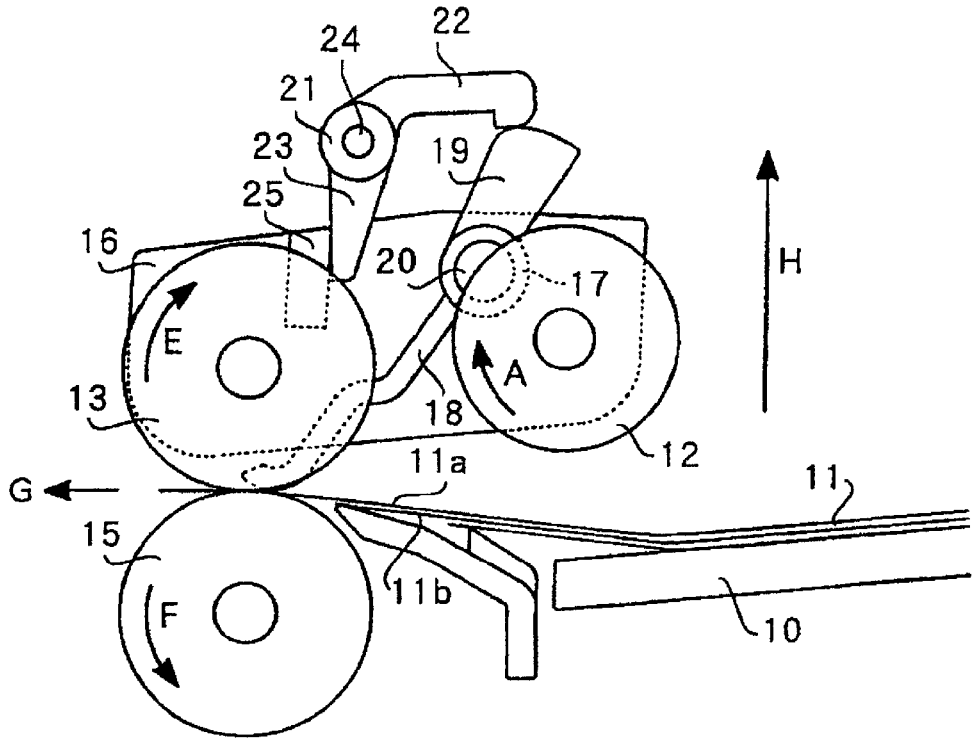
FIG. 5 is a drawing illustrating the device at a particular stage of basic paper feed operations in the paper feeder of the embodiment mentioned above.

FIG. 5 is a side cross-sectional view showing the mechanism component at a time that the papers 11 are pulled out by the paper feed rollers 13 and 15. As shown in FIG. 5, when the front edge of the paper 11*a* is transferred to the nip surface between the paper feed rollers 13 and 15, the pickup roller 12 starts moving up in the direction H in synchronization with the start of pivot arm 16 moving up in the direction H, by the restoring force of a not shown spring.

Then the pickup roller 12 disengages from the surface of the papers 11 and stops pulling out the papers 11. The second paper 11*b* is pulled out until the pickup roller 12 disengages from the upper surface of the paper 11, and stops at the position shown in the figure.

After that, the first paper 11*a* is continuously transferred along the path G by the paper feed rollers 13 and 15 rotating in the direction E or F. While the first paper 11*a* is continuously transferred along the path G, the pickup roller 12 keeps rotating in synchronization with the rotation of the paper feed rollers 13 and 15.

Figure 6:
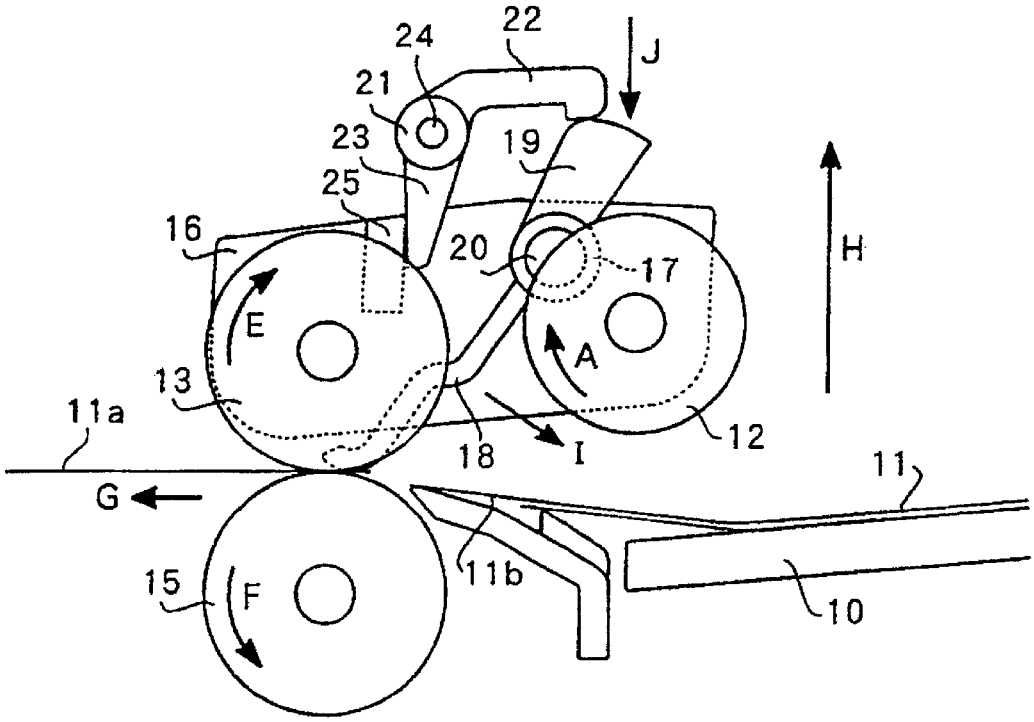
FIG. 6 is a drawing illustrating the device at a particular stage of basic paper feed operations in the paper feeder of the embodiment mentioned above.

FIG. 6 is a side cross-sectional view of the mechanism components showing their orientation when the papers 11 are transferred to the transfer path G by the paper feed rollers 13 and 15. As shown in FIG. 6, the first paper 11*a* is continuously transferred along the transfer path G by the paper feed rollers 13 and 15, and the rear edge of the first paper 11*a* leaves (i.e. advanced beyond) the first arm 18 of the front edge alignment member 17. Then the front edge alignment member 17 becomes rotatable without being pushed by the papers 11 because advancing of the papers 11 is stopped. And the front edge alignment member 17 starts returning in the direction I around the pivot support position 20 by the moment of inertia (MOI) of the first arm 18 of the front edge alignment member 17.

The second arm 23 of the stopper 21 becomes rotatable without being pushed by the stopper release member 25 since the pivot arm 16 moves up in the direction H by the restoring force of a spring not shown in the figure. The stopper 21 starts moving in the direction J around the pivot support position 24 by the MOI of the first arm 22 of the stopper 21.

Figure 7:
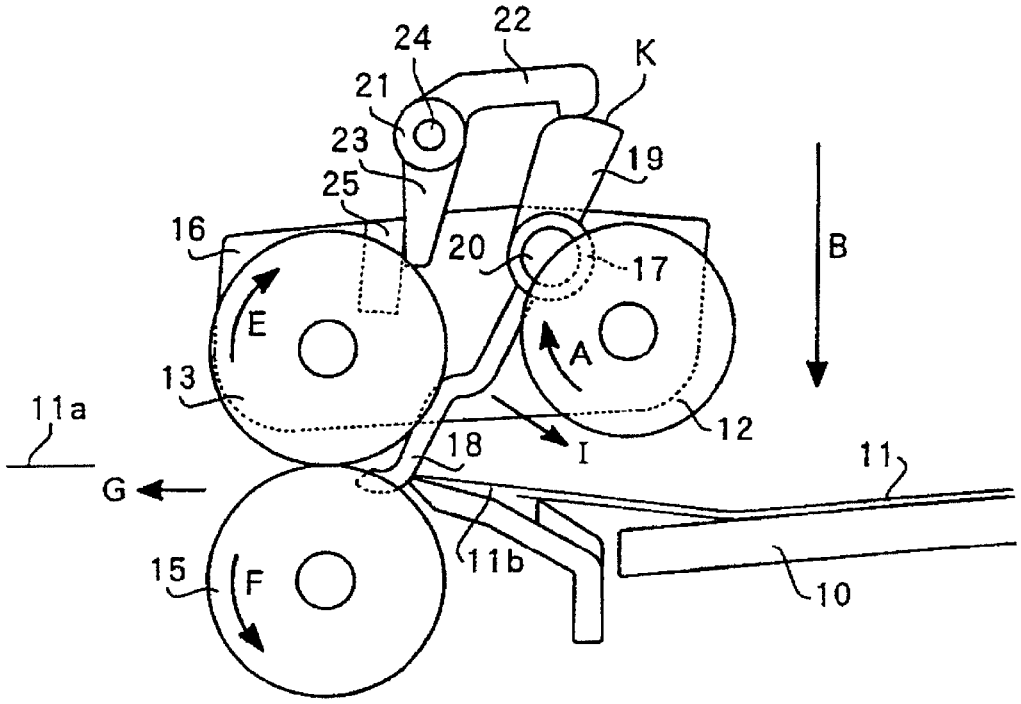
FIG. 7 is a drawing illustrating the device at a particular stage of basic paper feed operations in the paper feeder of the embodiment mentioned above.

FIG. 7 is a side cross-sectional view showing the orientation of the components when the papers 11 are transferred along the transfer path G by the paper feed rollers 13 and 15. When the rear edge of the first paper 11*a* is transferred onto the transfer path G from the paper feed rollers 13 and 15, the pivot arm 16 starts moving down in the direction B shown in the figure. The first arm 18 that kept returning in the direction I about the pivot support position 20 by the MOI of the first arm 18 of the front edge alignment member 17 contacts the front edge of the second paper 11*b* remaining in the paper tray 10, and stops.

Even if the front edge alignment member 17 stops at the position contacting the second paper 11*b*, the stopper 21 does not restrict the front edge alignment member 17, because the front edge alignment member 17 and the stopper 21 do not return to the restriction position. Therefore, the front edge alignment member 17 stays rotatable and does not prevent advance of the papers 11.

Figure 8:
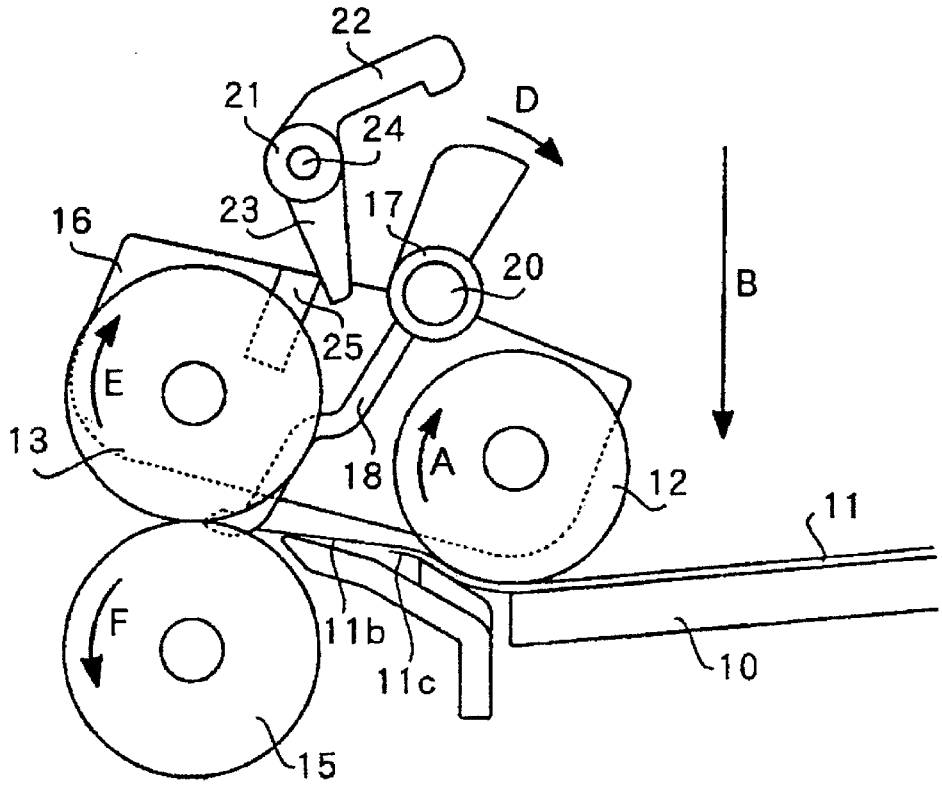
FIG. 8 is a drawing illustrating the device at a particular stage of basic paper feed operations in the paper feeder of the embodiment mentioned above.

FIG. 8 is a side cross-sectional view showing the orientation of the components when the papers 11 are pulled out again by the paper feed rollers 13 and 15. In synchronization with the pivot arm 16 that started moving down, the pickup roller 12 moves down in the direction B shown in the figure and contacts the upper surface of the second paper 11*b* stacked on the paper tray 10. Then the pickup roller 12 starts feeding the second paper 11*b*, that is on the top, to the paper feed rollers 13 and 15.

However, the front edge alignment member 17 is already rotatable even before the pickup roller 12 touches the upper surface of the papers 11, as mentioned above. Therefore, the front edge of the second paper 11*b* is pulled out by the friction force applied to the papers 11 by the rotation of the pickup roller 12 in the direction A without being restricted by the first arm 18 of the front edge alignment member 17. Further the front edge of the second paper 11*b* rotates the front edge alignment member 17 in the direction D as shown in the figure around the pivot support position 20 of the front edge alignment member 17.

The second paper 11*b* pulled out from the paper tray 10 continues to be pulled by the rotational friction force of the pickup roller 12 into the nip between the paper feed rollers 13 and 15. In this step, the third paper 11*c* below the second paper 11*b* fed from the paper tray 10 is also advances from the paper tray 10. Then the orientation of the components returns back to the configuration of FIG. 5.

Repeating the operations shown from FIG. 5 to FIG. 8, the paper sheets 11 stacked on the paper tray 10 are continuously advanced to the paper feed rollers 13 and 15. During these operations, the stopper 21 does not restrict the front edge alignment member 17 because the stopper 21 does not return to the right most restriction position.

Figure 9:
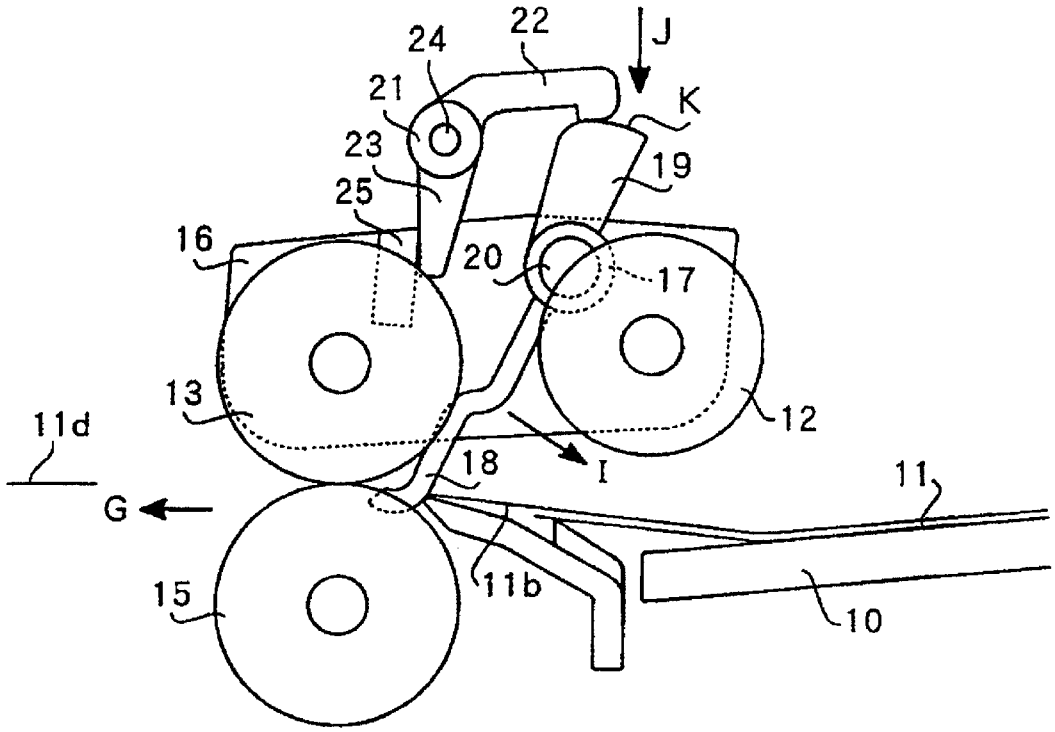
FIG. 9 is a drawing illustrating the device at a particular stage of basic paper feed operations in the paper feeder of the embodiment mentioned above.

FIG. 9 is a side cross-sectional view showing the orientation of the components when the paper feed operation of the paper 11 stops while the paper 11 remains on the tray 10. After the operation of FIG. 6, the apparatus proceeds to the situation of FIG. 9. As shown in FIG. 9, when the rear edge of the paper 11*d* is transferred from the nip surface between the paper feed rollers 13 and 15, the paper feed rollers 13 and 15 stop rotating. The rotation of the pickup roller 12 which synchronized to the rotation of the paper feed rollers 13 and 15 thus stops at the same time.

Then the first arm 18 of the front edge alignment member 17, that started returning in the direction I around the pivot support position 20 by the MOI of the first arm 18 of the front edge alignment member 17 contacts the front edge of the paper 11*b* remaining on the paper tray 10, and stops.

At this time, the first arm 22 of the stopper 21 is also returning in the direction J shown in the figure, but the stopper 21 stops since the front edge alignment member 17 stops before that. The stopper 21 stops at the position that the stopper 21 pushes the round shaped portion K at the edge of the second arm 19 of the front edge alignment member 17 with the weight of the first arm 22 of the stopper 21. Upward movement of the pivot arm 16 stops at the position that the stopper 21 stops. Thus, the operation of the paper feed is finished. When the operation of the paper feed is restarted, it is started from the position shown in FIG. 4.

Figure 10:
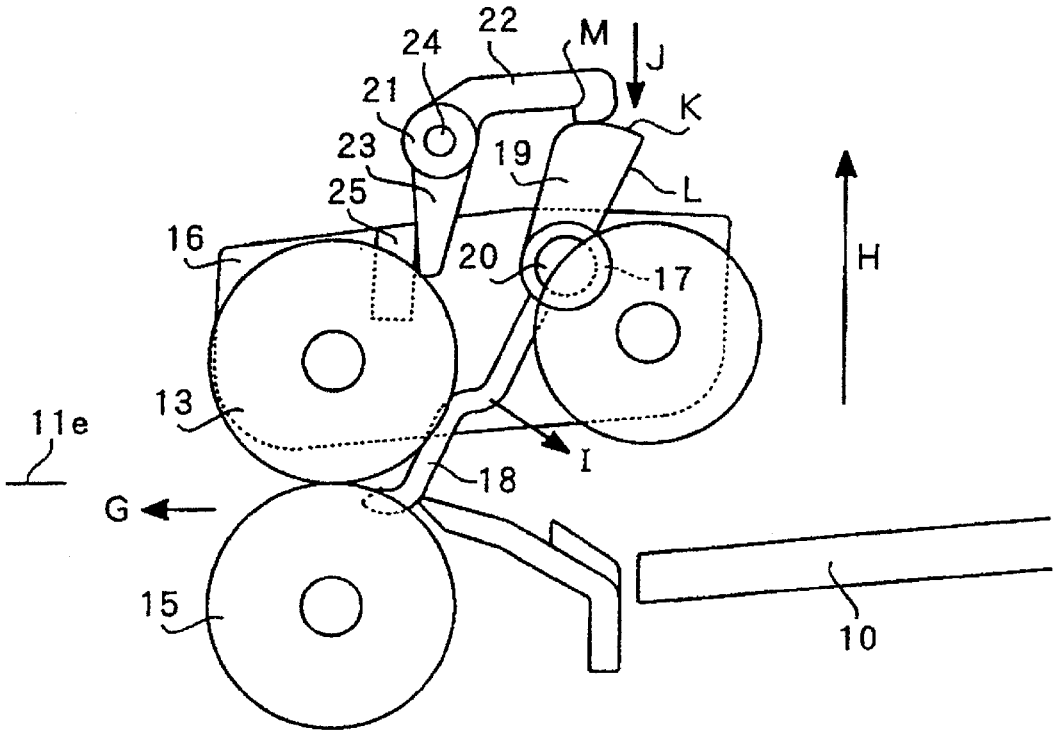
FIG. 10 is a drawing illustrating the device at a particular stage of basic paper feed operations in the paper feeder of the embodiment mentioned above.
Figure 11:
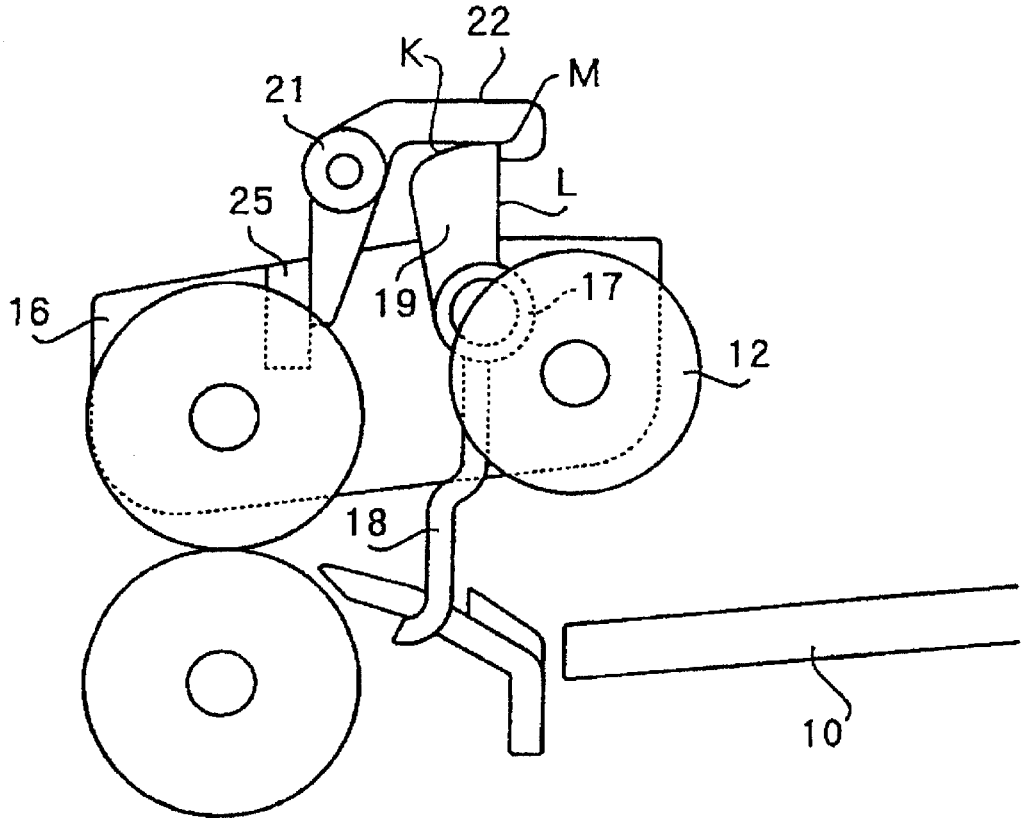
FIG. 11 is a drawing illustrating the device at a particular stage of basic paper feed operations in the paper feeder of the embodiment mentioned above.

Next, the orientation of the components when the operation of feeding the papers 11 ends after feeding all the papers 11 from the paper tray 10 is described using FIG. 10 and FIG. 11. FIG. 10 is a side cross-sectional view showing the orientation when the operation of advancing the last paper 11*e* has finished. After the end of the operation of FIG. 6 mentioned above, it goes to the orientation shown in FIG. 10.

As shown in FIG. 10, after the rear edge of the last paper 11*e* leaves the first arm 18 of the front edge alignment member 17, the front edge alignment member 17 keeps returning in the direction I shown in the figure around the pivot support position 20 by MOI of the first arm 18. Also, after the rear edge of the last paper 11*e* is transferred from the nip surface between the paper feed roller 13 and 15, the paper feed rollers 13 and 15 stop rotating, and the pickup roller 12 synchronized to them stops at the same time.

As mentioned above, the front edge alignment member 17 rotates when it is pushed by the papers 11, and it returns to the original position by MOI of the front edge alignment member 17 when it is not pushed by the papers 11. Thus, it does not need any other members for moving it to the original position. As a result, it is possible to reduce the number of members or components in the sheet feeding device.

When the pivot arm 16 moves up in the direction H shown in the figure by the restoring force of the spring, the stopper 21 moves in the direction J about the pivot support position 24 by the MOI of the first arm 22 of the stopper 21.

The pivot support position is provided so that MOI of the first arm 22 of the stopper 21 is larger than that of the second arm 23.

By this arrangement, the stopper release member 25 presses the stopper 21, rotates it, and releases the pivot prevention of the front edge alignment member 17. Thereafter, when the pressure of the stopper release member 25 is released, the stopper 21 returns to the position to restrict pivoting of the front edge alignment member 17 by its own MOI. Thus it is not necessary to return it by another member, making it possible to suppress the increase of number of members.

The first arm 18 of the front edge alignment member 17 keeps returning in the direction I shown in the figure and the first arm 22 of the stopper 21 returns to the direction J shown in the figure. As the result, the front edge alignment member 17 reaches the waiting position first, and then the stopper 21 restricts pivoting of the front edge alignment member 17 so that it remains at the waiting position.

The MOI of the second arm 19 of the front edge alignment member 17 is larger that that of the first arm 22 of the stopper 21. Further, the portion K, which is an end portion of the second arm 19 of the front edge alignment member 17 and contacts the first arm 22 of the stopper 21 upon return of the front edge alignment member 17, has a rounded shape.

When return of the stopper 21 to the position that restricts pivoting of the front edge alignment member 17 is faster than return of the front edge alignment member 17 to the waiting position, the returning motion of the front edge alignment member 17 is influenced by the contact of the stopper 21. However, the first arm 22, which contacts the portion K of the front edge alignment member 17, is moved to the normal position by the MOI of the stopper because the portion K has a rounded shape and the effect of friction at the contact area is small.

On the other hand, the front edge alignment member 17 is moved to the normal waiting position by the MOI of the front edge alignment member 17 because the portion K has round shape and the effect of the friction due to the contact of the first arm 22 and the portion K is small. Further, by providing that the MOI of the second arm 19 of the front edge alignment member 17 is larger than that of the first arm 22 of the stopper 21, the front edge alignment member 17 has more force to return to the normal waiting position than the force of the stopper 21. As the result, the front edge alignment member 17 moves to the waiting position against the contact force of the stopper 21.

FIG. 11 is a side cross-sectional view showing the orientation of the feeding device components when the front edge alignment member 17 returned to the original waiting position after completion of the feeding operation of the last paper. As shown in FIG. 11, when the pivot arm 16 moves up, the stopper 21 restricts pivoting of the front edge alignment member 17 at the waiting position. The projection M of the first arm 22 of the stopper 21 bears against the straight shaped portion L of the second arm 19 and fixes the front edge alignment member 17 firmly.

Thus the stopper 21 can control pivoting of the front edge alignment member 17 at the waiting position reliably only by the returning movement of the stopper 21 and that of the front edge alignment member 17.

The pivot arm 16 stops moving up at the waiting position at which the stopper 21 fixes the front edge alignment member 17. The stopper release member 25 keeps the stopper 21 at the restricted position and paper feed operation ends. When paper feed operation starts again, it starts from the orientation of FIG. 2 mentioned above.

As mentioned above, when the pickup roller 12 moves up, the stopper 21 prevents pivoting of the front edge alignment member 17. On the other hand, when the pickup roller 12 moves down, the stopper 21 releases the restriction on the pivoting of the front edge alignment member 17. As the result, it is possible to reliably synchronize the up and down movement of the front edge alignment member 17 and the up and down movement of the pickup roller 12.

By making the stopper 21 and the front edge alignment member 17 as two armed members, it is possible to make the front edge alignment member 17 rotatable or to reliably restrict pivoting only by the up and down movement of the pickup roller 12 because of the static force of the stopper 21 and the front edge alignment member 17. Further more, it is possible to simplify the mechanism and to save space inside the equipment.

Figure 12A:
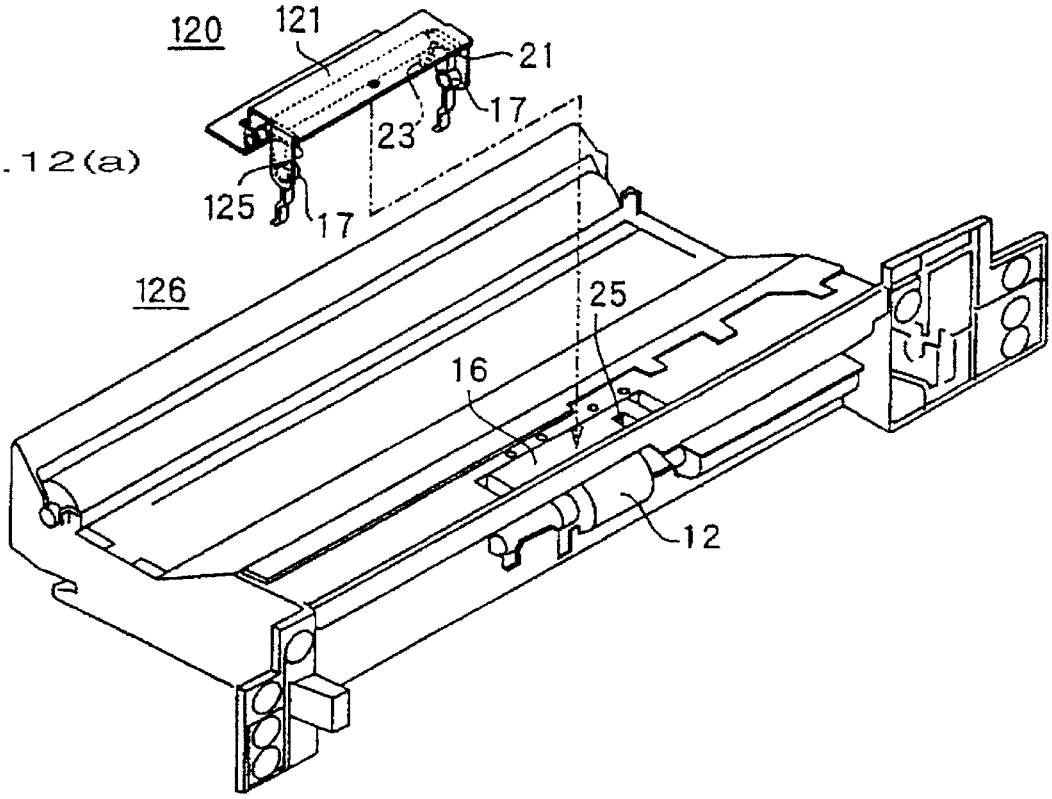
FIGS. 12*a* and 12*b* are perspective views showing the internal structure of a manual paper feeder to which the present invention is applied.
Figure 12B:
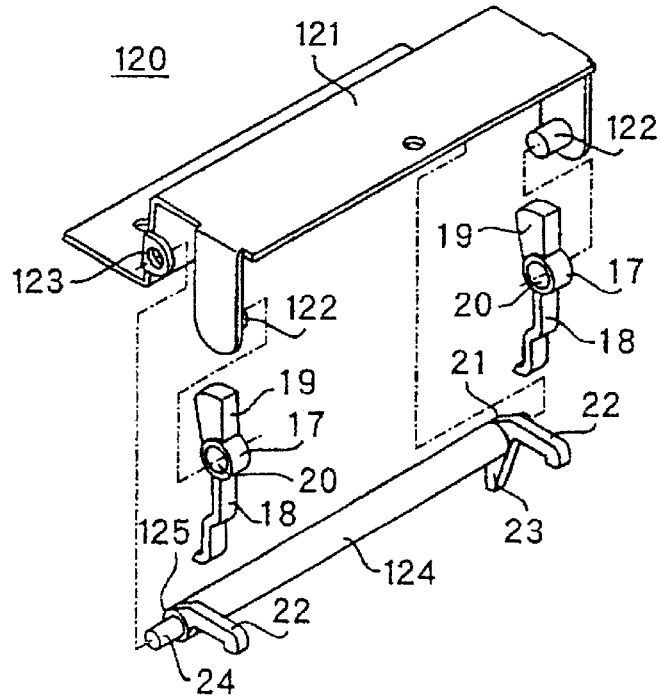
Figure 13:
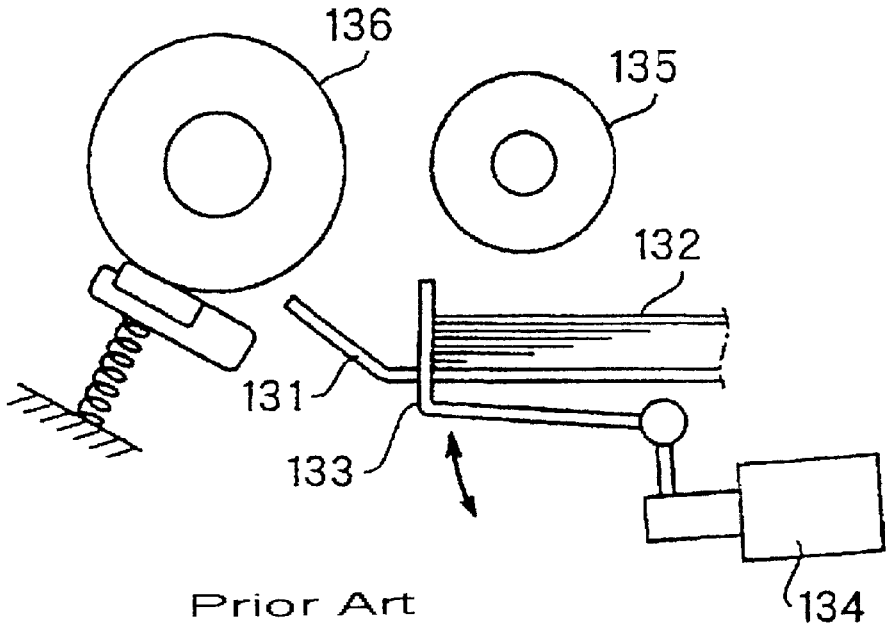
FIG. 13 is a side cross-sectional view showing the internal structure of a conventional paper feeder.
Figure 14A:
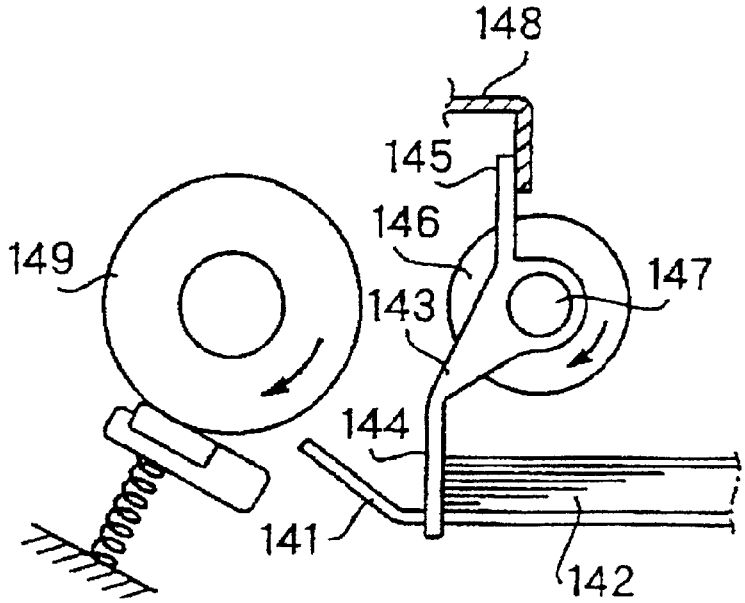
FIGS. 14*a* and 14*b* are side cross-sectional views showing the internal structure of a conventional paper feeder.
Figure 14B:
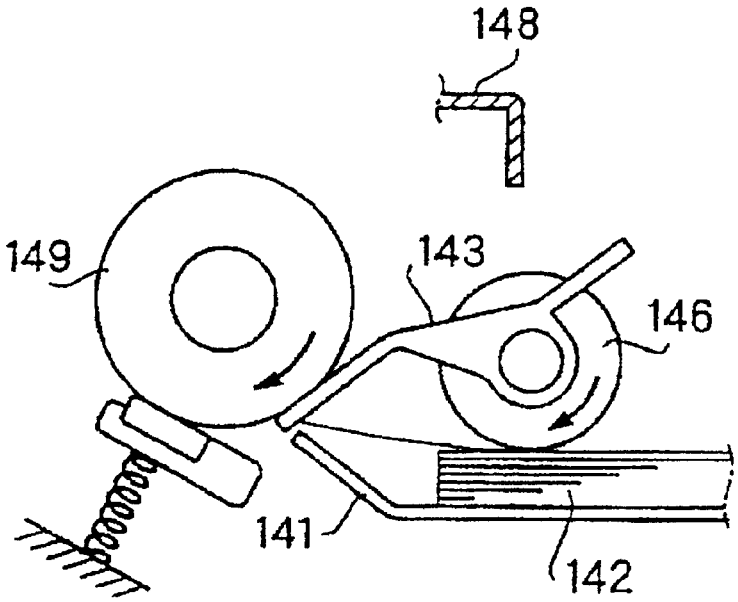
Prior Art Fig. 14(b)

Next, an embodiment in which the present invention mentioned above is applied to a manual paper feeder is described. The manual paper feeder of the present embodiment is a paper feeder of basic structure in which two stoppers and two front edge alignment members are installed. FIG. 12 is a perspective view showing the inside structure of the manual paper feeder of the present invention.

FIG. 12(*a*) is a perspective view showing a mounting apparatus 120 fixed to the manual paper feeder 126. As shown in FIG. 12(*a*), the mounting apparatus 120 comprises two front edge alignment members 17 and two stoppers 21, 12*s* which are supported by a mounting member 121. Two front edge alignment members 17 hold the pickup roller 12 in between, and are positioned in the connecting section of the manual paper feeder 126. The second arm 23 of the first stopper 21 is interlocked with the stopper release member 25 of the pivot arm 16 that is pivotably provided in the manual paper feeder to pivot around the pivot support position of the paper feed roller.

Thus it is possible to improve workability of the device and to reduce the production time required for the assemby process of the front edge alignment member 17 and the stopper 21 because only by inserting the pre-assembled mounting member 121 from the upper side, the front edge alignment member 17 and the stopper 21 are fixed at the operation position.

FIG. 12(*b*) is a perspective view of the inside structure of the mounting apparatus 120. As shown in FIG. 12(*b*), the mounting apparatus 120 comprises two independent front edge alignment members 17 and two stoppers 21, 125 connected by a stopper connection member 124, which are pivotably provided at the mounting member 121. The pivot support 20 of the front edge alignment members 17 is pivotably mounted to the axles 122 of the mounting member 121. The stoppers 21 and 125 are mounted to two bearings 123 of the mounting member 121 by the axle that extends through the pivot support 24 of the stoppers 21 and 125.

The first stopper 21, which comprises the first arm 22 and the second arm 23, restricts the first front edge alignment member 17 from pivoting by the first arm 22. Further the second arm 23, pushed by the stopper release member 25, pushes the first arm 22 up, and makes the front edge alignment member 17 rotatable. On the other hand the second stopper 125, comprising only the first arm 22, is connected by the first stopper 21 and a stopper connecting member 124 to the pivot support point 24. The second stopper 125 restricts or releases the second front edge alignment member 17 from the first arm 22 of the second stopper 125 in accordance with the control operation of the first stopper 21.

Thus since two front edge alignment members 17 are installed, it is possible to reliably prevent tilted feeding of the papers 11. Even when the papers 11 are pushed strongly against the front edge alignment members 17, it is possible to smoothly move the pickup roller 12 down because the pressure at the front edge alignment members 17 is dispersed. Also, since the stoppers 21 and 125 are provided interconnected, one stopper release member 25 can raise two stopper 21 and 125. As a result, the two front edge alignment sections 17 become rotatable.

This application is based on the Japanese Patent Application No. 2000-286324 filed on Sep. 21, 2000, entire content of which is expressly incorporated by reference herein.

What is claimed is:

1. A paper feeder comprising:

a pickup roller movable in a vertical direction, said pickup roller moving down to a top sheet of a stack of paper and advancing a sheet to a paper feed roller;

two pivotably mounted front edge alignment members that align a front edge of the advancing sheet, said two front edge alignment members being independent of each other;

two pivotably mounted stoppers that engage said front edge alignment members to restrict pivoting of said front edge alignment members, said two stoppers being coupled together; and a stopper release member that pivots said stoppers in association with downward movement of said pickup roller in order to release said stoppers from said front edge alignment member, wherein said front edge alignment members and said stoppers are configured to be installable from a top side of the paper feeder.

2. A paper feeder according to claim 1, wherein said pickup roller is mounted on a pivot arm that moves up and down about a paper feed roller shaft.

3. A paper feeder according to claim 2, wherein said stopper release member is an integral portion of the pivot arm.

4. A paper feeder comprising:

a pickup roller movable in a vertical direction, said pickup roller moving down to a top sheet of a stack of paper and advancing a sheet to a paper feed roller;

a pivotably mounted front edge alignment member that aligns a front edge of the advancing sheet, said front edge alignment member comprising a first arm and a second arm that extend in opposite directions from a pivot of said front edge alignment member;

a pivotably mounted stopper that engages said front edge alignment member to restrict pivoting of said front edge alignment member, said stopper comprising a first arm and a second arm that extend in opposite directions from a pivot of said stopper; and a stopper release member that pivots said stopper in association with downward movement of said pickup roller in order to release said stopper from said front edge alignment member.

5. A paper feeder according to claim 4 wherein, the first arm of said front edge alignment member aligns the front edge of stacked papers, the first arm of said stopper restricts pivoting of said front edge alignment member by engaging the second arm of said front edge alignment member, said stopper release member engages the second arm of said stopper in accordance with the downward movement of said pickup roller to make the second arm of said stopper pivot, and release the first arm of said stopper from the second arm of said front edge alignment member.

6. A paper feeder according to claim 5, wherein the pivot of said stopper is positioned so that a moment of inertia of the first arm of said stopper is larger than a moment of inertia of the second arm of said stopper.

7. A paper feeder according to claim 5, wherein an edge portion of the second arm of said front edge alignment member, which contacts the first arm of said stopper, is a curved surface.

8. A paper feeder according to claim 5, wherein said stopper release member is positioned so that said stopper restricts pivoting of said front edge alignment member close to the second arm of said stopper.

9. A paper feeder according to claim 4, wherein A said front edge alignment member and said stopper are configured to be installable from a top side of the paper feeder.

10. A paper feeder according to claim 9, wherein two front edge alignment members and two stoppers are provided, said two front edge alignment members being independent and two stoppers being coupled together.

11. A paper feeder according to claim 4, wherein said pickup roller is mounted on a pivot arm that moves up and down about a paper feed roller shaft.

12. A paper feeder according to claim 11, wherein said stopper release member is an integral portion of the pivot arm.

* * * * *

UNITED STATES PATENT AND TRADEMARK OFFICE

CERTIFICATE OF CORRECTION

PATENT NO. : 6,598,873 B2
DATED : July 29, 2003
INVENTOR(S) : M. Takisawa et al.

It is certified that error appears in the above-identified patent and that said Letters Patent is hereby corrected as shown below:

Column 12,
Line 30, delete "A".

Signed and Sealed this

Fourth Day of May, 2004

JON W. DUDAS
*Acting Director of the United States Patent and Trademark Office*